United States Patent [19]

Bonney

[11] 4,178,694

[45] Dec. 18, 1979

[54] POINT-OF-AIM INDICATOR

[76] Inventor: Maurice C. Bonney, 48 Primrose St., Aptos, Calif. 95003

[21] Appl. No.: 752,604

[22] Filed: Dec. 20, 1976

[51] Int. Cl.[2] ..... G01C 15/00; A63B 21/00; A63D 13/00

[52] U.S. Cl. ..... 33/289; 35/29 R; 273/14

[58] Field of Search ..... 33/289; 273/2, 14; 35/29 R

[56] References Cited

U.S. PATENT DOCUMENTS

| | | | |
|---|---|---|---|
| 3,843,120 | 10/1974 | Ricci | 33/289 |
| 3,947,026 | 3/1976 | Scoutten | 33/289 |

*Primary Examiner*—Steven L. Stephan
*Attorney, Agent, or Firm*—Robert G. Slick

[57] ABSTRACT

A point-of-aim indicator for pool balls or the like which includes a relatively flat base member which has thereon a center line which is adapted for alignment with the vertical axis of an object ball together with means indicating the desired contact point of a cue ball with an object ball and the desired point of aim for the cue ball to establish contact with object ball at such contact point.

5 Claims, 7 Drawing Figures

Fig-2
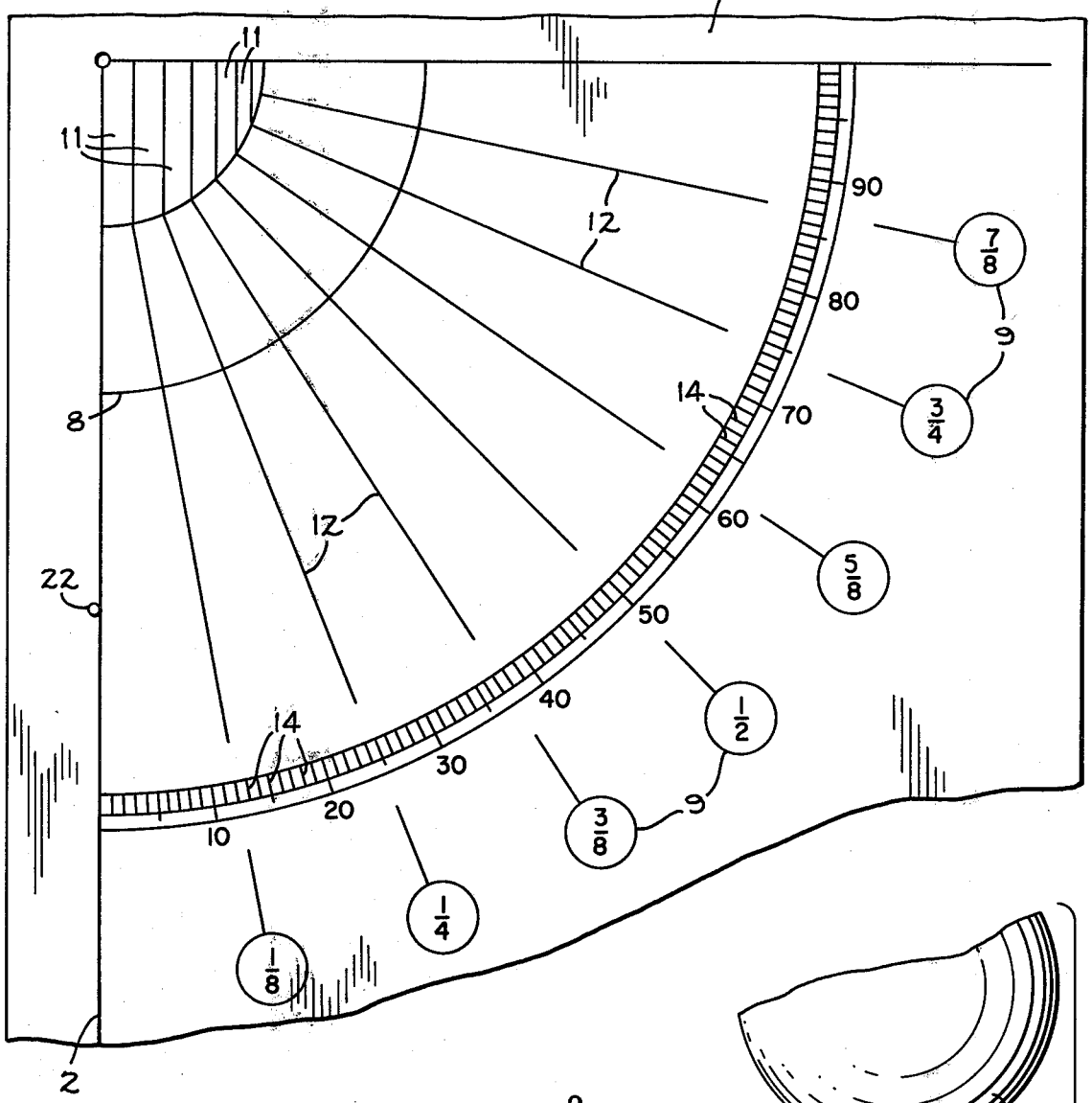
Fig-4
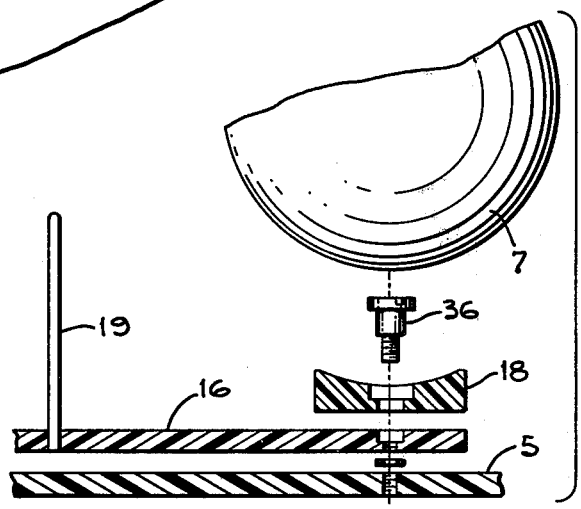
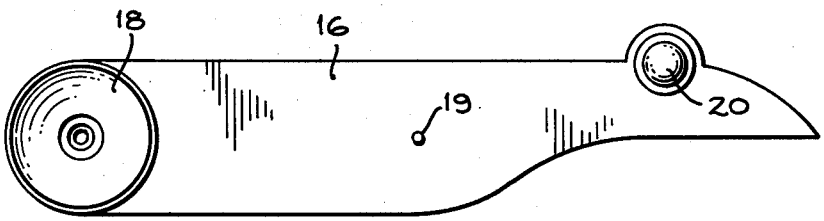
Fig-3

POINT-OF-AIM INDICATOR

FIELD OF THE INVENTION

The present invention relates to aiming devices and more particularly to a point of aim indicator which will assist a participant to achieve excellence in the playing of a game of pool.

BACKGROUND OF THE INVENTION

As is well known, in the playing of pool, snooker, billiards, or similar games, it is necessary for the player to propel a cue ball along an appropriate direction to establish contact with an object ball at a position such that the latter will travel in the desired direction. More particularly, using as an example the playing of pool, the desired objective of impelling an object ball into a pocket essentially involves four prerequisites. First, the correct target (not necessarily the pocket itself) for the object ball must be chosen. Secondly, based on the target position, an accurate estimate of the object ball-cue ball contact point must be made. In the third place, the correct point of aim for the cue ball direction of travel must be determined to insure that the required contact point is encountered. Finally, an accurate stroke of the cue in establishing the appropriate direction of the cue ball must be made.

All of these prerequisites have been established primarily in the past by a trial and error method. For example, the "target" is generally considered by pool players, as the center of the pocket and, in turn, the contact point is established by mentally constructing a line from the center of the pocket through the center of vertical axis of the object ball. In turn, the point of aim is established by an imaginary line parallel to that of the contact point depending upon the amount of lateral motion of the object ball required and the accurate stroke is provided by trial and error practice. All of these have necessitated for the most part an extensive period of time before any proficiency in the playing of pool can be established.

The foregoing is, in and of itself, an oversimplification for as well known to any expert in the playing of pool, if a second "key" ball is placed adjacent an object ball with the two having contact established at the desired contact point in accordance with the above-stated principles, if a cue ball hits the "key" ball left of center, the travel or trajectory of the object ball will be thrown off to the right and to the contrary, if the cue ball contacts the "key" ball on its right side, the object ball will be thrown off line to the left. Such phenomenom is generally referred to by pool players as "throw" but few players realize that a corresponding phenomenom also occurs when a cue ball directly contacts an object ball without the intervening disposition of the key ball. As a consequence, a careful study of the travel of a cue ball and the impelled object ball indicated the error in the previously stated principle of establishing a contact point by drawing an imaginary line from the pocket through the vertical axis or center of the object ball.

Thus, any pool player who desires to become proficient must be aware of this basic "throw" phenomenon and be able to estimate the correct "target" in order to correctly locate the desired contact point on the object ball and, in turn, the point of aim. Obviously, it is also necessary that any player who is to become proficient must be capable of precise manipulation of the cue in order to achieve the proper stroke.

SUMMARY OF THE PRESENT INVENTION

Accordingly, it is the general objective of the present invention to provide a point-of-aim indicator which enables a pool player, who has established a basic knowledge of the throw phenomenon and the capability of executing a precise stroke, to determine precisely the point of aim of the cue ball to assure the proper travel or trajectory of the object ball to the desired pocket or position.

Such objective can be achieved with various structures, which however, have common elements facilitating achievement of the objective. More particularly, each embodiment of the invention includes a relatively flat base member having a center line formed thereon which is adapted for horizontal alignment with the central vertical axis of the object ball either mentally or literally. Associated with such base member is means for indicating the desired contact point of the cue ball with the object ball together with a correlated means or mechanism indicating the point of aim of the cue ball to establish contact with the object ball at the desired contact point.

More particularly, in one embodiment, the mentioned base member supports a simulated object ball so that such arrangement can be used at any location so that the prospective pool player can practice away from a pool table. The simulated pool ball includes a dot on its central circumference to represent the desired point of contact and such ball is mounted on a pivoted member so that the ball and the point of contact simulated thereon can be moved to any desired rotative position. Such pointer is associated with appropriate lines on the base member indicating the desired angle of contact ultimately related to the target position and the pivoted pointer also mounts an upright pin at an appropriate distance from the simulated object ball to provide indication of the required point of aim to establish contact between a cue ball and the object ball at the noted point of contact.

Additional simplified embodiments of the invention include a flat base member with appropriate indications thereon through the use of designated points or pins of the desired contact point on an object ball to achieve its desired trajectory and a correlated point of aim position of the cue ball to establish contact with the object ball at such required position.

BRIEF DESCRIPTION OF THE DRAWINGS

The stated objective of the invention and the manner in which it is achieved as summarized hereinabove will become more readily understood by reference to the following detailed description of the exemplary embodiments of the invention shown in the accompanying drawings wherein:

FIG. 2 is a top plan view of a portion of the FIG. 1 structure, FIG. 3 is a top plan view of the pivoted pointer shown also in FIG. 1, FIG. 4 is an exploded fragmentary sectional view taken along line 4—4 of FIG. 1.

DETAILED DESCRIPTION OF THE EXEMPLARY EMBODIMENTS OF THE INVENTION

Figure 1:
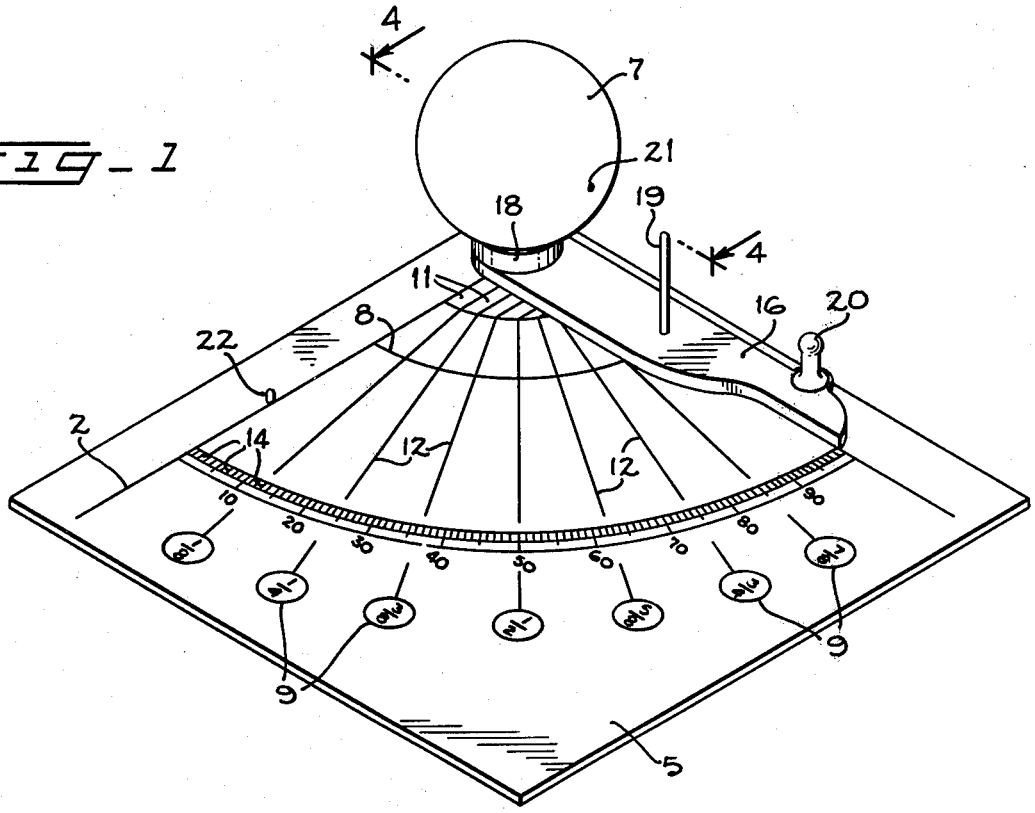
FIG. 1 is a perspective view of a point-of-aim indicator embodying the present invention.

With initial reference to FIGS. 1-4, the illustrated embodiment of the invention constitutes a self-contained unit which includes an object ball 7 so that such unit can be used for instructional or training purposes at any location. More particularly, the object ball 7 is supported on a generally spherical socket 18 best shown in FIG. 4 that is mounted at one end of a pointer 16 supported for pivotal motion about a substantially vertical axis which coincides with the central vertical axis of the object ball 7 on a relatively flat base member 5 of appropriate lateral dimensions which can be laid on any flat surface for instructional purposes. The pivotal axis and thus the central vertical axis of the ball is in alignment with a center line 2 on the base member 5 which includes additional indicating lines 12 at spaced angles on a horizontal plane which clearly indicate the position of the pointer 16 as it is pivoted about its vertical axis. As indicated in FIGS. 1 and 2, the indicating lines 12 are at equal angular intervals of one-eighth of a 90° arc and preferably additional radial demarcations 14 in terms of percent of the full 90° arcuate interval are also indicated on the base member to enable precision in the indicating process. Preferably, each of the arcuate intervals indicated on the base member 5 are provided with indicating circles 9 of different colors to enable quick determination of the precise angle and the base member 5 is similarly provided with lines parallel to the described center line 2 to indicate colored sections 11 between the required points of contact. Thus, when the pointer 16 is pivotally moved, the contact point 21 on the ball 7 will be disposed at one position or another relative to the supporting base member 5 to provide a quick visual indication of the appropriate disposition of such ball-contacting point. Preferably, the base member is also provided with another 90° arcuate line 8 which underlies the position of a pin 19 on the pointer as it is moved about its pivotal axis. It is to be understood that the disposition of the pin and the underlying 90° arc is spaced from the surface of the object ball 7 a distance equivalent to the radius of a standard pool ball so that such pin actually indicates the central vertical axis of a contacting cue ball when it is in engagement with the contact point 21 on the object ball 7.

As best shown in FIG. 4, the ball supporting socket 18 is pivotally secured to the base member by a simple screw member 36 which can be removed, if for example, an object ball of different dimensions is required such as for snooker ball which is slightly smaller than that of a conventional pool ball and other lines (not shown) can be placed on the base member 5 and a different pin position can be arranged on the pointer to accommodate such variable diameter balls.

To facilitate adjustment of the pointer 16 to a desired position, a handle 20 is secured adjacent the outer end thereof to enable manual grasping and ease of adjustment thereof. Additionally, a stop 22 restrains additional motion of the pointer 16 when it attains alignment with the center line 2.

In use, the player arbitrarily pivots the pointer 16 to different positions (e.g. $\frac{1}{8}$) so that the pin 19 and the center of the object ball 7 are aligned with each choosen position. The desired position of the contact point 21 is thus determined and by sighting towards the upstanding point of aim pin 19 on the pointer, the player can mentally train himself to recognize the relationship of the contact point and correlated point of aim.

As previously indicated, the structure illustrated in FIGS. 1-4 can be utilized at any location, but other embodiments of the invention are illustrated which are of somewhat simpler construction and are utilized by a player at a pool table. More particularly, with reference to FIG. 5, a generally flat rectangular base member 5' is provided with a center line 2' having adjacent numberical indicia 9' indicating the appropriate angular contact points on an object ball as indicated by the points 21' at various point of contact positions. At each of these positions, essentially parallel bars 28 project laterally from the described center line 2' to and beyond the represented contact points 21' and at a further distance corresponding to some of the angular intervals of the first embodiment, is another indicating point 19' which provides the desired point of aim. To facilitate an understanding of the unit, each of the parallel bars has at an equal distance from the center line 2', a short arcuate line 26 generally indicating the circumferential disposition of the object ball at its exterior periphery. Preferably the distance on the bars 28 to the contact point is indicated by a particular color (e.g. yellow), the distance to the point of aim is indicated in another color (e.g. red) and any intervening distance between the point of contact and the ball periphery is in yet another color (e.g. white).

Figure 5:
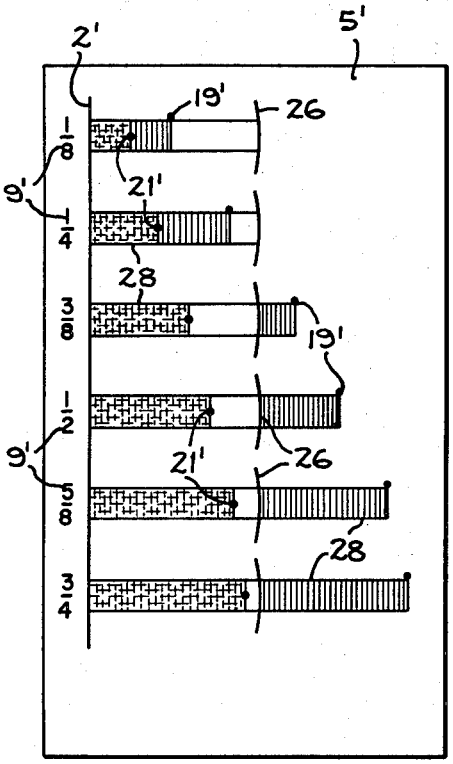
FIG. 5 is a top plan view of a modified embodiment of the invention which can be utilized by the player at the pool table.

In use, the unit shown in FIG. 5 is held in hand and will be viewed by the player. By comparison with the contact point location on the object ball on the table with the corresponding contact point on the unit, the desired point of aim towards which the cue ball must be stroked to assure the required direction of motion of the object ball can be visualized.

Figure 6:
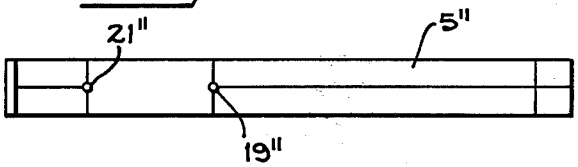
FIG. 6 is a top plan view of a further modified embodiment of the invention useable with a ball on the pool table.
Figure 7:
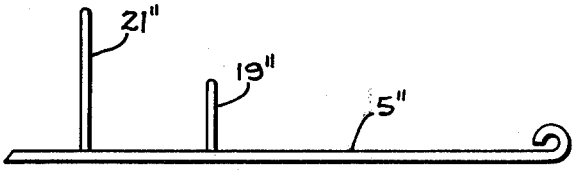
FIG. 7 is a side elevational view of the FIG. 6 structure illustrating additional structural details.

Yet another embodiment of the invention is shown in FIGS. 6 and 7 which can be used on a pool table with an existing object ball thereon to establish the desired contact point and point of aim. As illustrated, this unit also includes a relatively flat base member 5" which is a relatively thin elongated structure having two upstanding pins 21", 19", one of which is arranged to contact the object ball when the device is properly aligned with the target. This establishes the desired point of contact and the other pin 19" on the same center line of the unit but at a distance spaced therefrom the equivalent to the radius of the cue ball, establishes the point of aim for the cue ball, thus if the one pin 21" is placed in contact with an object ball, the point of aim cf the cue ball to make contact with the object ball at that point is automatically established and can be utilized by the player to establish the direction of the cue ball propulsion.

In summary, in each embodiment of the invention, once the player has established the requirements for establishing a target position and has mastered the appropriate cue contact with the cue ball, the illustrated devices enable a quick determination of the desired point of aim of the cue ball to establish appropriate contact point to achieve the desired trajectory of the object ball into the pocket or to whatever position is desired.

It will be apparent that yet other modifications and/or alterations in the structures as described can be envisioned without departing from the spirit of the invention and the foregoing description of three embodiments accordingly is to be considered as purely exemplary and not in a limiting sense and the actual scope of the invention is to be indicated only by reference to the appended claims.

What is claimed is:

1. A point-of-aim indicator for pool balls or the like which comprises a relatively flat base member, means forming a center line on said base member adapted for horizontal alignment with the central vertical axis of an object ball, means on said base member indicating the desired contact point of a cue ball with the object ball, and means on said base member correlated with said contact point to indicate the point of aim for the cue ball to establish contact with the object ball at said contact point, said contact point indicating means including a simulated object ball having an indicating point on its surface, and means supporting said ball for angular adjustment about a vertical axis aligned with said center line wherein said ball supporting means includes a pointer supported for pivotal motion about a vertical axis of said ball.

2. A point-of-aim indicator according to claim 1 wherein said pointer includes a vertical pin spaced from said ball periphery by a distance equivalent to the radius of a pool ball.

3. A point-of-aim indicator according to claim 1 wherein said contact point indicating means includes a series of parallel lines on said base member projecting perpendicularly from said center line, each line having a different point indicating one of a series of desired contact points, and said point-of-aim indicating means includes on each of said parallel lines an additional point indicating the point of aim correlated with the contact point on the respective line.

4. A point-of-aim indicator according to claim 3 wherein each of said parallel lines has a curved intersecting line representing the arc of an object ball centered on said center line.

5. A point-of-aim indicator according to claim 1 wherein said contact point indicating means includes a first pin rising from said base member and adapted to contact an object ball at a desired contact point, and said point of aim indicating means includes a second pin rising from said base member at a position spaced from said first pin by a distance equivalent to the radius of a pool ball, said first and second pins being in horizontal alignment along said center line.

* * * * *